US007378583B2

(12) United States Patent
Rose

(10) Patent No.: US 7,378,583 B2
(45) Date of Patent: May 27, 2008

(54) TAMBOURINE WITH REMOVABLE JINGLES

(76) Inventor: John Rose, 6942 Barth Rd., Shawnee, KS (US) 66226

( * ) Notice: Subject to any disclaimer, the term of this patent is extended or adjusted under 35 U.S.C. 154(b) by 0 days.

(21) Appl. No.: 11/534,728

(22) Filed: Sep. 25, 2006

(65) Prior Publication Data

US 2008/0072736 A1 Mar. 27, 2008

(51) Int. Cl.
*G10D 13/08* (2006.01)

(52) U.S. Cl. ..... 84/402
(58) Field of Classification Search ..... 84/402–405, 84/418, 419
See application file for complete search history.

(56) References Cited

U.S. PATENT DOCUMENTS

| | | | | |
|---|---|---|---|---|
| 3,657,465 | A | 4/1972 | Koishikawa | |
| 4,230,015 | A | 10/1980 | Taninbaum | |
| 4,858,510 | A | 8/1989 | Shimoda et al. | |
| 5,040,446 | A | 8/1991 | Cohen et al. | |
| 5,284,079 | A * | 2/1994 | Wang | 84/418 |

* cited by examiner

*Primary Examiner*—Kimberly Lockett
(74) *Attorney, Agent, or Firm*—Dale J. Ream

(57) ABSTRACT

A tambourine according to the present invention includes a frame having a plurality of removable jingle members. The frame includes opposing sides and defines a plurality of slots extending between the sides. The tambourine includes a plurality of pins that may be extended through the frame and the plurality of slots for coupling respective jingle members to the frame. A plurality of fasteners are included for coupling the pins to the frame. Alternately, threaded inserts may be coupled to the frame for receiving threaded fasteners, such as screws, therein.

11 Claims, 6 Drawing Sheets

TAMBOURINE WITH REMOVABLE JINGLES

BACKGROUND OF THE INVENTION

The present invention relates to a tambourine and, more particularly, to a tambourine having removable jingles.

The jingles of a tambourine are an extremely important part of that musical instrument. Unfortunately, the jingles tend to wear out long before the remainder of the instrument, such as the frame. As the jingles begin to wear down, the tonal quality of the instrument diminishes. To maintain an optimal sound, the entire tambourine must be replaced. Further, percussionists often must have several different tambourines that each have their own distinctive sound using different jingles.

Tambourines having various configurations have been proposed in the art for producing particular sounds. Although assumably effective for their intended purposes, these products still require that completely new tambourines be purchased when the jingles wear out even though the remainder of the frame is still in good condition. Further, a percussionist may need to switch tambourines between performances if a different sound is required.

Therefore, it would be desirable to have a tambourine in which the jingles were removable such as for replacing worn out jingles without having to replace the entire tambourine. Further, it would be desirable to have a tambourine with removable jingles such that jingles of different sizes or varieties may be interchanged.

SUMMARY OF THE INVENTION

Accordingly, a tambourine according to the present invention includes a frame and a plurality of jingles coupled to the frame. The frame defines a plurality of slots and includes pins configured and arranged for selectively coupling respective jingles. Fasteners are included for securing respective pins in place. The fasteners and frame may include complementary threaded configurations for removably coupling the fasteners to the frame.

Therefore, a general object of this invention is to provide a tambourine having removable jingles.

Another object of this invention is to provide a tambourine, as aforesaid, in which one set of jingles may be efficiently removed and replaced with another set of jingles.

Still another object of this invention is to provide a tambourine, as aforesaid, that is easy to use.

A further object of this invention is to provide a tambourine, as aforesaid, that is inexpensive to manufacture.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A tambourine 100 according to the present invention will now be described in detail with reference to FIGS. 1*a* through 6 of the accompanying drawings. More particularly, a tambourine 100 according to the current invention includes a frame 110 and a plurality of jingle members 120 removably coupled to the frame 110.

Figure 1A:
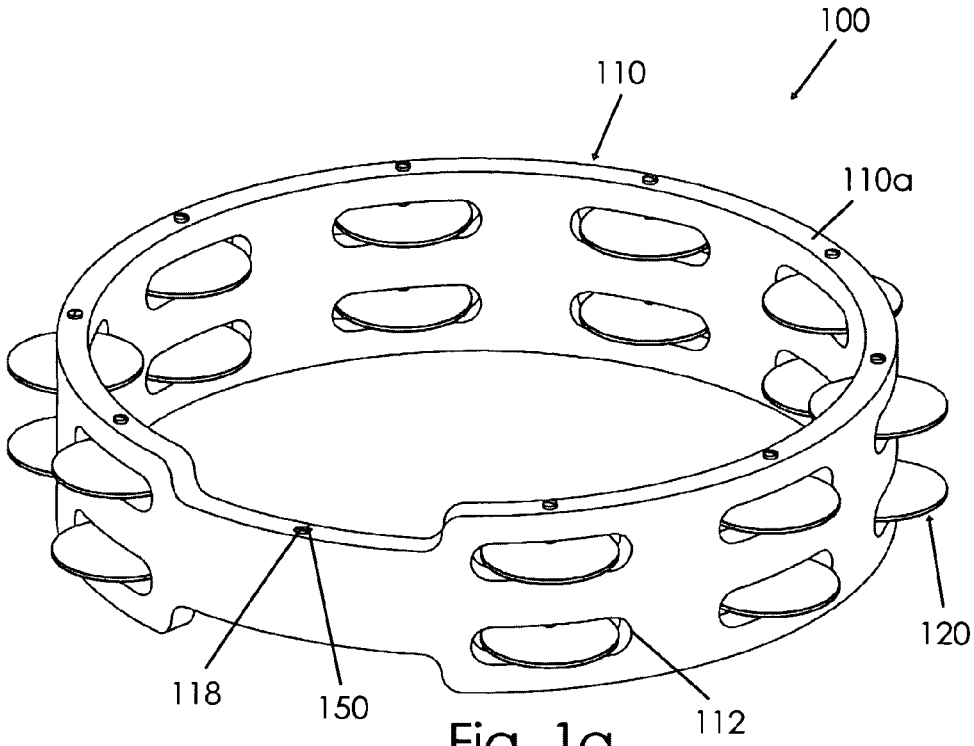
FIG. 1*a* is a top perspective view of a tambourine according to a preferred embodiment of the present invention.
Figure 1B:
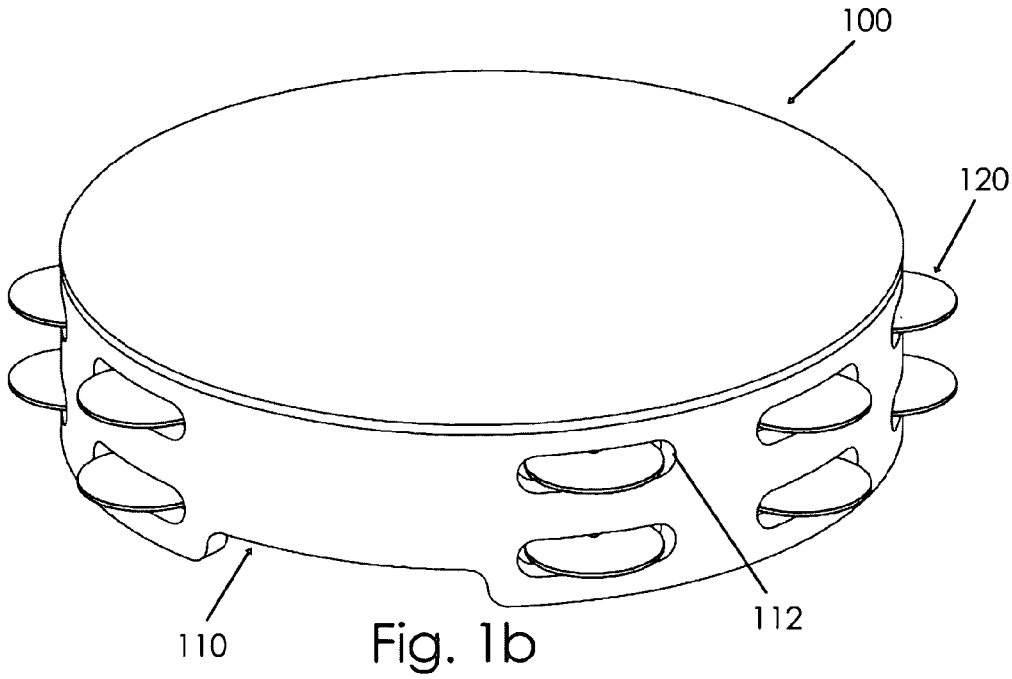
FIG. 1*b* is a bottom perspective view of the tambourine as in FIG. 1*a;*
Figure 2:
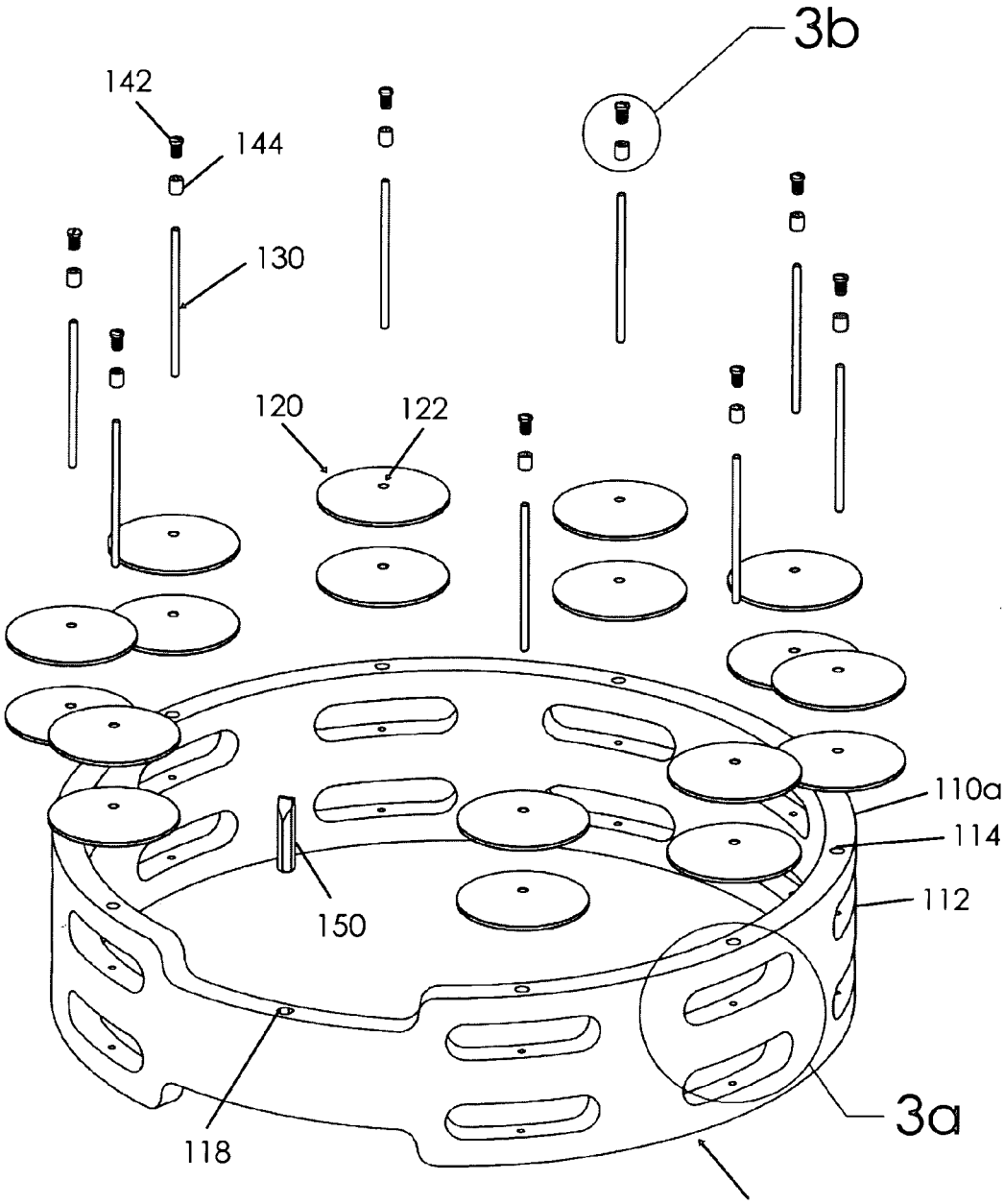
FIG. 2 is an exploded view of the tambourine as in FIG. 1*a;*
Figure 3A:
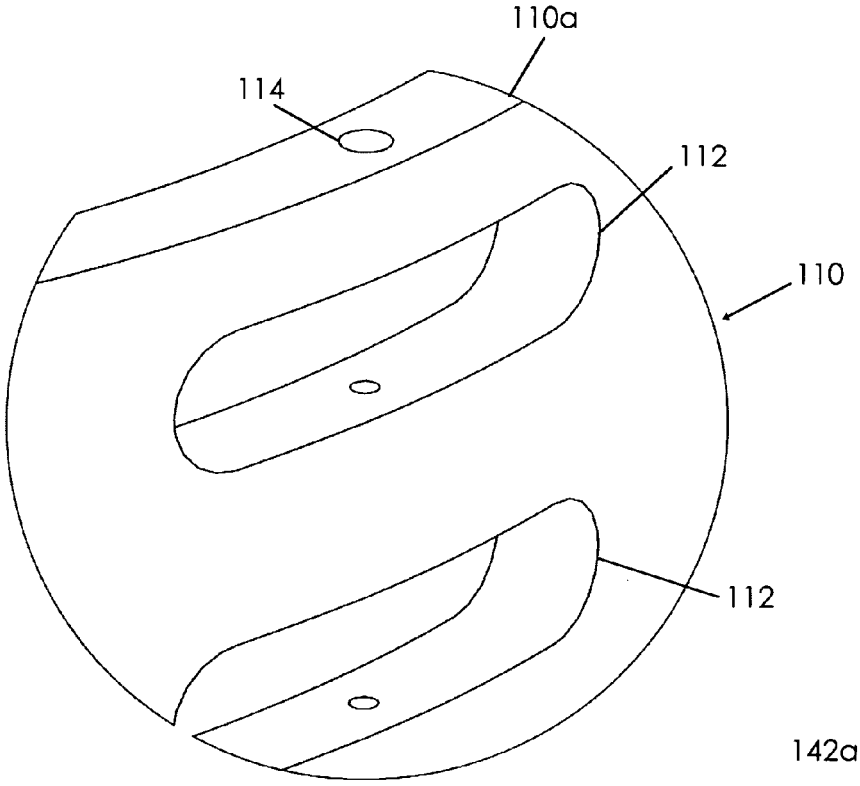
FIG. 3*a* is an isolated view on an enlarged scale of a portion of the tambourine taken from FIG. 2.
Figure 3B:
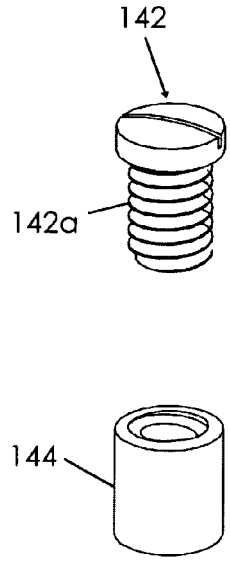
FIG. 3*b* is a perspective view of a threaded insert and screw fastener for an alternative use of the tambourine as in FIG. 1*a;*

The frame 110 presents opposed first and second sides 110*a*, 110*b* (best shown in FIG. 4*b*) and defines at least one slot 112 between the first and second sides 110*a*, 110*b*. As shown in FIG. 2, the frame 110 may define a plurality of slots 112, and the frame 110 may define an opening 114 from the first side 110*a* to each slot 112 (FIG. 4*b* through FIG. 6).

A pin 130 may be inserted through a respective frame opening 114 and a respective slot 112 to removably couple respective jingle members 120 to the frame 110 at a respective slot 112. As shown throughout the drawings, and especially at FIG. 4*b* through FIG. 6, a single pin 130 may couple multiple jingle members 120 to the frame 110 at adjacent slots 112. A plurality of pins 130 may be used, as shown in FIG. 2.

Figure 4A:
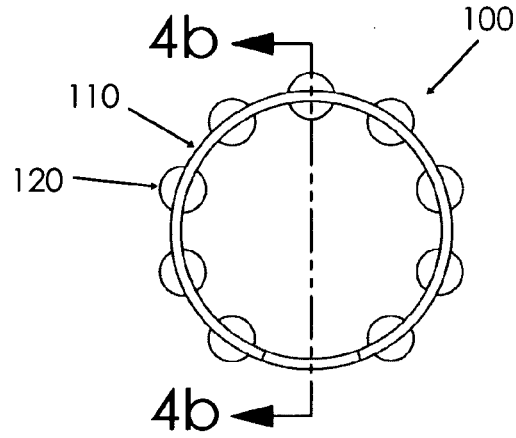
FIG. 4*a* is a top view of the tambourine as in FIG. 1*a;*
Figure 4B:
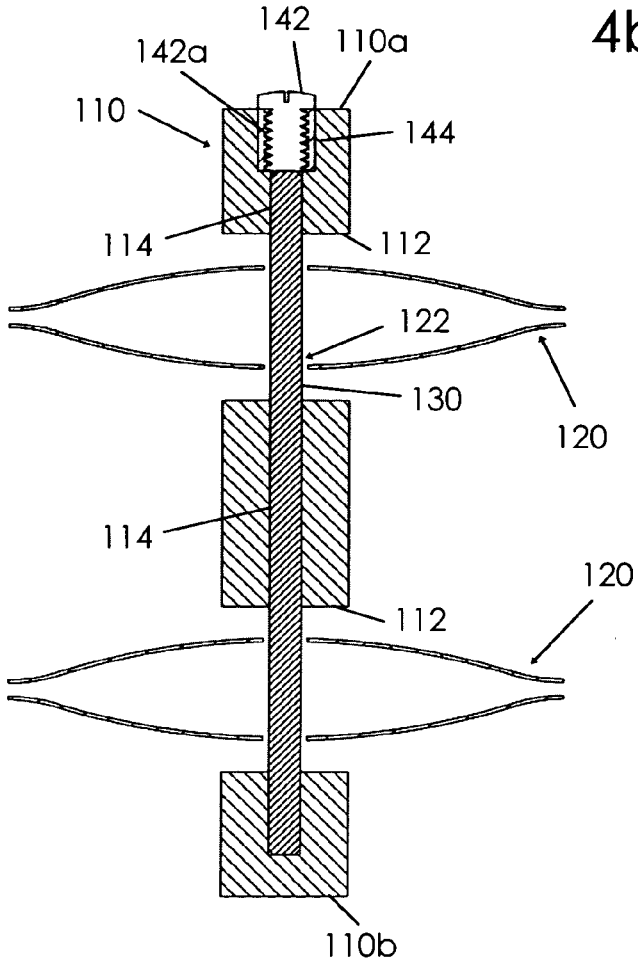
FIG. 4*b* is a sectional view of the tambourine taken along line 4*b*-4*b* of FIG. 4*a* in use with a fastener and complementary insert.
Figure 5:
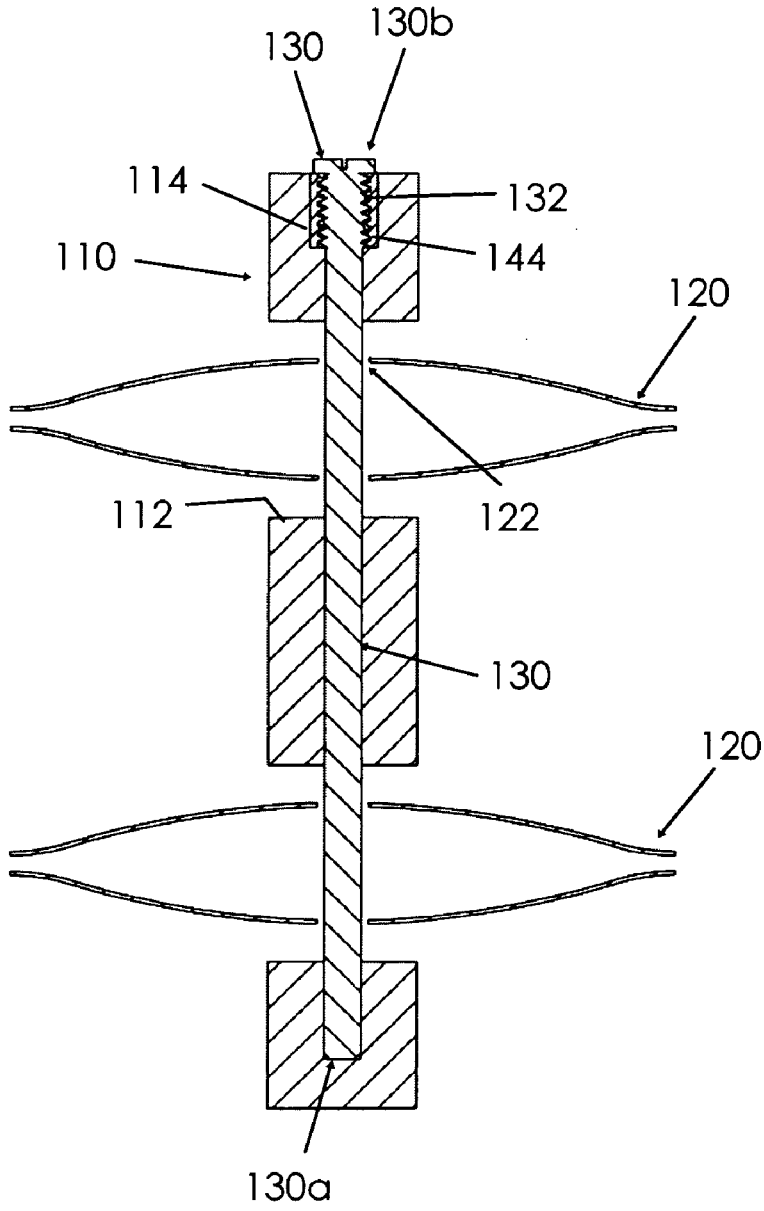
FIG. 5 is a sectional view as in FIG. 4*b* in use with a pin having a threaded end complementary to a threaded fastener.
Figure 6:
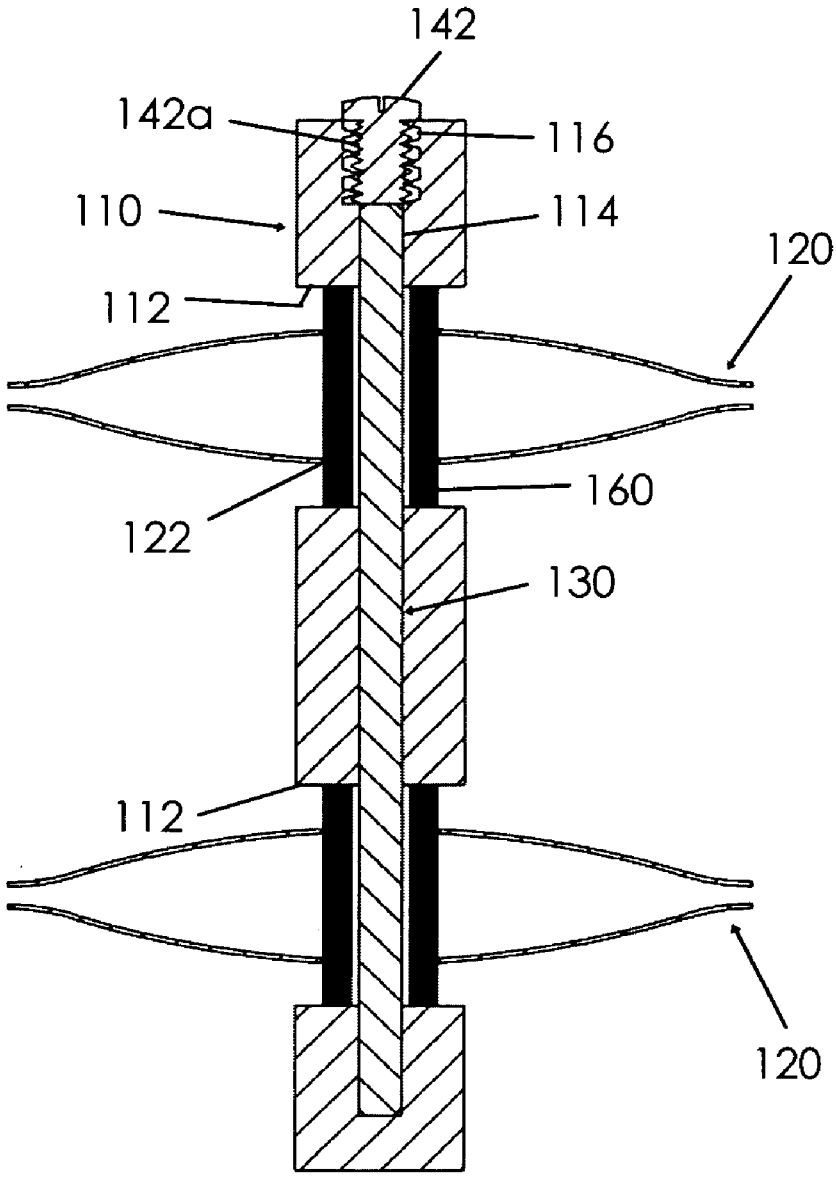
FIG. 6 is a sectional view as in FIG. 4*b* in use with sleeves.

Means for coupling each pin 130 to the frame 110 are included. More particularly, according to some embodiments, a fastener 142 is operatively coupled to the frame 110 at a respective frame opening 114 to selectively secure the pin 130 to the frame 110. As shown in FIG. 6, the frame 110 may define internal threads 116 at each opening 114, and the fasteners 142 may be screws having threads 142*a* complementary to the frame threads 116 for removably coupling the screws 142 to the frame 110 at the openings 114. Alternately, as shown in FIG. 4*b*, threaded inserts 144 may be coupled to the frame 110 at the openings 114, and the fasteners 142 may be screws having threads 142*a* complementary to the threaded inserts 144 for operatively and removably coupling the screws 142 to the frame 110 at the openings 114. According to another embodiment, each pin 130 presents first and second ends 130*a*, 130*b*, and each second end 130*b* defines threads 132 complementary to the threaded inserts 144 for operatively and removably coupling the pins 130 to the frame 110 at the openings 114 (FIG. 5) without use of fasteners 142. Alternately, each pin second end 130*b* may define threads 132 (FIG. 5) complementary to the frame threads 116 (FIG. 6) for removably coupling the pins 130 to the frame 110 at the openings 114 without use of fasteners 142.

As shown in FIG. 2, the housing 110 may further define a cavity 118, and a driver bit 150 may be selectively housed in the cavity 118. The driver bit 150 may be complementary to the fasteners 142 or the pin second ends 130*b* for selectively coupling the fasteners 142 or the pins 130 to the frame 110 and for selectively detaching the fasteners 142 or the pins 130 from the frame 110.

Each pin 130 presents a pin diameter, and each jingle member 120 defines a central opening 122 and has an inner diameter. As shown in FIG. 5, a first set of jingle members 120 may have a first inner diameter complementary to the pin diameter. As shown in FIG. 6, a second set of jingle members 120 may have a second inner diameter that is larger than the first inner diameter. For such a second set of jingle members 120, a respective sleeve 160 may be positioned outwardly adjacent each pin 130; each sleeve 160 may have an outer diameter complementary to the jingle member 120 inner diameter (FIG. 6). In other words, each sleeve 160 may have an inner diameter that is complementary to the diameter of the pin 130 and an outer diameter that is complementary to the inner diameter of the second set of jingle members 120. As such, when the first set of jingle members 120 is not coupled to the frame 110, a respective second set of jingle members 120 may be located in a slot 112 outwardly adjacent a respective sleeve 160, and the sleeve 160 may be outwardly adjacent a respective pin 130 (FIG. 6).

In use, a plurality of first sets of jingle members 120 (FIG. 4*b*) may be positioned in slots 112, and pins 130 may be inserted through frame openings 114 and through the central openings 122 of the jingle members 120 to couple the jingle members 120 to the frame 110. If the pins 130 include threads 132 as described above, the pins 130 may be screwed into the frame threads 116 or the threaded inserts 144, depending on which is present. If the pins 130 do not include threads 132, fasteners 142 may be used couple the pins 130 to the frame 110 as described above. The driver bit 150 may be used to screw the pins 130 or the fasteners 142. When the first set of jingle members 120 becomes worn, or when the user desires a sound that can be provided by a second set of jingle members 120, the user may remove the pins 130 from the frame 110 (e.g., by using the driver bit 150) and then remove the first sets of jingle members 120 from the slots 112 (FIG. 2). The new jingle members 120 may then be installed in the same manner as that described above. If the second set of jingle members 120 has a larger inner diameter than the first set of jingle members 120, however, the sleeves 160 may be used as described above to effectively increase the diameter of the pins 130 (FIG. 6). By having interchangeable and replaceable jingle members 120, the tambourine 100 does not have to be discarded when worn, and multiple tambourines 100 are not needed to obtain different sounds from different types of jingle members 120.

It is understood that while certain forms of this invention have been illustrated and described, it is not limited thereto except insofar as such limitations are included in the following claims and allowable functional equivalents thereof.

What is claimed is as follows:

1. A tambourine, comprising a frame and a plurality of jingle members removably coupled to said frame;

said frame presents opposed first and second sides;

said frame defines a plurality of slots between said first and second sides;

a plurality of pins may be inserted through said frame and said plurality of slots to couple said jungle members to said frame at said slots;

said frame first side defines a plurality of openings;

said pins are inserted through said frame at said openings;

a plurality of fasteners are operatively coupled to said frame at said openings to selectively secure said pins to said frame;

said frame defines internal threads at said openings; and said fasteners are screws having threads complementary to said frame threads for removably coupling said screws to said frame at said openings.

2. The tambourine of claim 1, further comprising means for coupling said pins to said frame.

3. The tambourine of claim 1, wherein:

said frame defines a cavity; and a driver bit is selectively housed in said cavity, said driver bit being complementary to said fasteners for selectively coupling said fasteners to said frame and selectively detaching said fasteners from said frame.

4. The tambourine of claim 1, wherein:

said pins present first and second ends, said second ends defining threads complementary to said frame threads for removably coupling said pins to said frame at said openings.

5. The tambourine of claim 1, wherein:

each respective pin presents a pin diameter;

each respective jingle member defines a central opening and has an inner diameter; and a respective sleeve is positioned outwardly adjacent each said pin, each respective sleeve having an outer diameter complementary to said jingle member inner diameter.

6. A tambourine, comprising:

a frame presenting opposed first and second sides, defining a slot between said first and second sides, and defining an opening from said first side to said slot;

a first set of jingle members;

a pin for insertion through said frame opening and said slot to removably couple said first set of jingle members to said frame at said slot;

wherein a fastener is operatively coupled to said frame at said frame opening to selectively secure said pin to said frame;

a threaded insert is coupled to said frame adjacent said opening; and said fastener is a screw having threads complementary to said threaded insert for operatively and removably coupling said screw to said frame at said opening.

7. The tambourine of claim 6, further comprising means for coupling said pin to said frame.

8. The tambourine of claim 6, wherein:

said frame defines a cavity; and a driver bit is selectively housed in said cavity, said driver bit being complementary to said fastener for selectively coupling said fastener to said frame and selectively detaching said fastener from said frame.

9. The tambourine of claim 6, wherein:

said frame defines internal threads at said frame opening; and said pin presents first and second ends, said second end defining threads complementary to said frame threads for removably coupling said pin to said frame at said opening.

10. The tambourine of claim 6, wherein said pin presents first and second ends, said second end defining threads complementary to said threaded insert for operatively and removably coupling said pin to said frame at said opening.

11. The tambourine of claim 7, wherein:

said pin presents a pin diameter, said first set of jingle members has a first inner diameter complementary to said pin diameter;

a second set of jingle members has a second inner diameter, said second inner diameter being larger than said first inner diameter;

a sleeve has an inner diameter complementary to said pin diameter and an outer diameter complementary to said second inner diameter; and said second set of jingle members may be located in said slot outwardly adjacent said sleeve and said sleeve may be outwardly adjacent said pin when said first set of jingle members is not coupled to said frame.

* * * * *